US007136612B2

(12) United States Patent
Nooyens et al.

(10) Patent No.: US 7,136,612 B2
(45) Date of Patent: Nov. 14, 2006

(54) CONNECTION ASSEMBLY FOR A XEROGRAPHIC CHARGING DEVICE

(75) Inventors: Ludovicus A. M. Nooyens, Eindhoven (NL); Peter J. M. Bloemen, Cuijk (NL)

(73) Assignee: Xerox Corporation, Stamford, CT (US)

( * ) Notice: Subject to any disclaimer, the term of this patent is extended or adjusted under 35 U.S.C. 154(b) by 99 days.

(21) Appl. No.: 10/899,346

(22) Filed: Jul. 26, 2004

(65) Prior Publication Data

US 2006/0018682 A1 Jan. 26, 2006

(51) Int. Cl.
*G03G 15/02* (2006.01)
*H01T 19/04* (2006.01)

(52) U.S. Cl. ..... 399/170; 250/324

(58) Field of Classification Search ..... 399/170, 399/171, 172, 173; 361/225; 250/324, 325
See application file for complete search history.

(56) References Cited

U.S. PATENT DOCUMENTS 4,110,811 A 8/1978 Hubble, III et al.
4,627,701 A * 12/1986 Onoda et al. ..... 399/170
5,079,668 A * 1/1992 Maeshima ..... 361/229
5,257,073 A 10/1993 Gross et al.
5,539,205 A * 7/1996 Reale ..... 250/324
5,909,608 A 6/1999 Manno et al.

OTHER PUBLICATIONS

Photographs of scorotron connectors used in prior art Xerox(R) printer models 5028 and DocumentCentre 265(R).

* cited by examiner

*Primary Examiner*—Sandra L. Brase
(74) *Attorney, Agent, or Firm*—R. Hutter

(57) ABSTRACT

A scorotron used in xerography is connected to a voltage source within a printing apparatus through a pin. The pin is anchored in an insulative end block which defines channels therein, each channel enclosing a portion of a corona member which extends the length of the scorotron. Each corona member defines a specially-shaped opening, the openings of a plurality of corona members being aligned to accept the pin therethrough. A cover block is placed over the end block to complete the enclosure of the portions of the corona member. The cover block also defines a collar which surrounds a portion of the pin, and lugs on which a screen of the scorotron is mounted.

18 Claims, 6 Drawing Sheets

CONNECTION ASSEMBLY FOR A XEROGRAPHIC CHARGING DEVICE

TECHNICAL FIELD

The present disclosure relates to xerographic printing apparatus, and particularly to a connector by which a charging device, such as a corotron or a scorotron, is connected to a voltage source within a machine.

BACKGROUND

In the well-known process of electrostatographic or xerographic printing, an electrostatic latent image is formed on a charge-retentive imaging surface, typically a "photoreceptor," and then developed with an application of toner particles. The toner particles adhere electrostatically to the suitably-charged portions of the photoreceptor. The toner particles are then transferred, by the application of electric charge, to a print sheet, forming the desired image on the print sheet. An electric charge can also be used to separate or "detack" the print sheet from the photoreceptor.

For the initial charging, transfer, or detack of an imaging surface, the most typical device for applying a predetermined charge to the imaging surface is a "corotron," of which there are any number of variants, such as the scorotron or dicorotron. Common to most types of corotron is one or more bare conductors, in proximity to the imaging surface, which is electrically biased and thereby supplies ions for charging the imaging surface. The conductor typically comprises a wire (often called a "corona wire") or a metal bar or ribbon forming saw-teeth (a "pin array"). The conductor extends parallel to the imaging surface and along a direction perpendicular to a direction of motion of the imaging surface. Other structures, such as a screen, conductive shield and/or nonconductive housing, are typically present in a charging device, and some of these may be electrically biased as well. A corotron having a screen or grid disposed between the conductor and the photoreceptor is typically known as a "scorotron".

The present disclosure relates to a connector by which a charging device, such as a corotron or a scorotron, is connected to a voltage source within a xerographic printing machine.

SUMMARY

According to one aspect, there is provided a charging device useful in an electrostatographic printing apparatus, comprising a first corona member and a second corona member. An end block defines at least two channels therein, each channel substantially encasing a portion of a corona member. A conductive pin is anchored in the end block. Each of the first corona member and second corona member define an opening engaging a portion of the conductive pin. A cover block substantially covers the channels in the end block.

DETAILED DESCRIPTION

Figure 1:
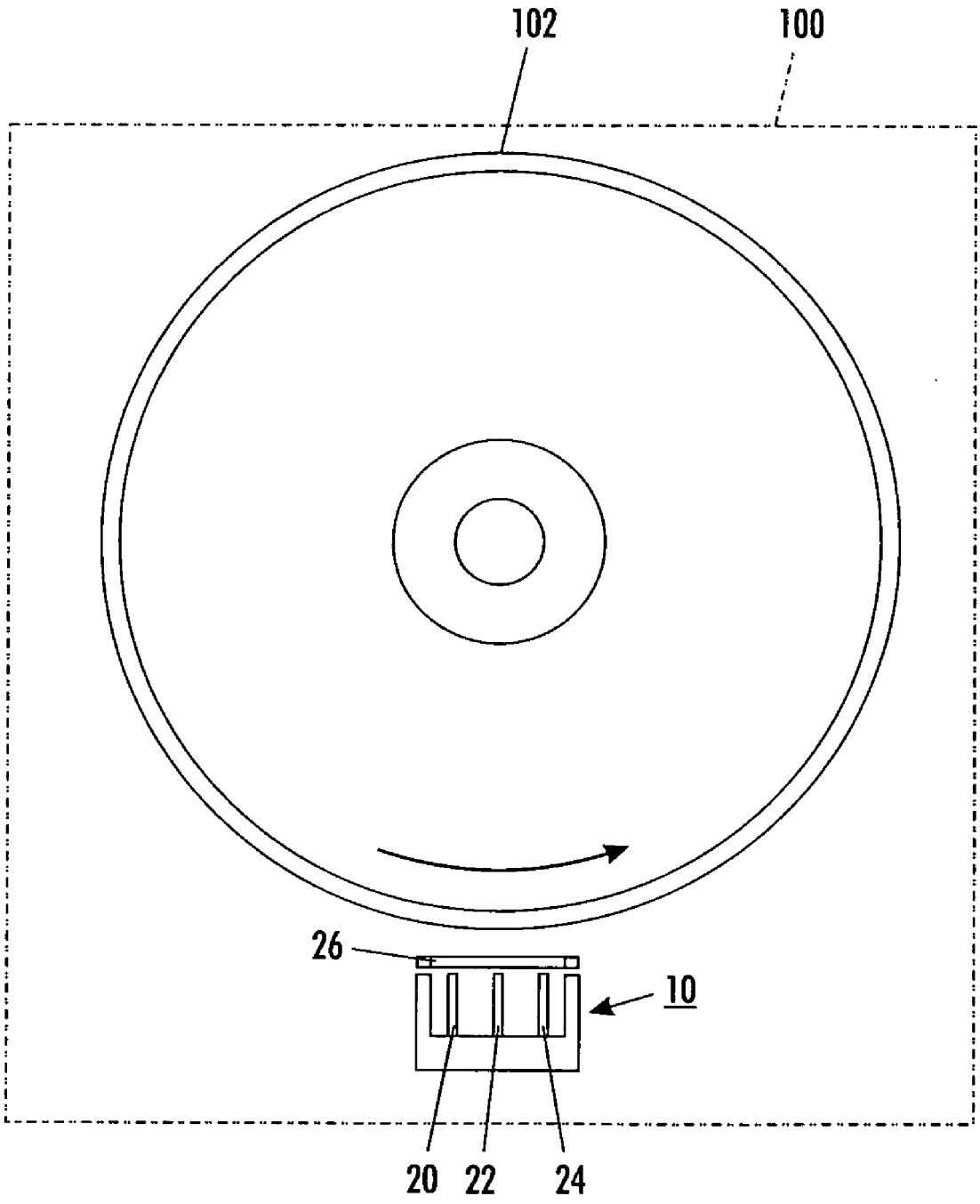
FIG. 1 PRIOR ART
FIG. 1 is a simplified, elevational, sectional view showing certain elements of an electrostatographic or xerographic printing apparatus.

FIG. 1 is a simplified, elevational, sectional view showing certain elements of an electrostatographic or xerographic printing apparatus, generally indicated as 100. As is well known, electrostatic latent images are created on a rotating charge receptor, such as shown as photoreceptor 102, which is here shown as a drum but in other designs could be in the form of a belt. Various stations (not shown) familiar in xerography, such as exposure, development, and cleaning stations, are arranged around the photoreceptor 102. As used herein, the term "printing apparatus" can refer either to an entire printing machine or copier, or to a replaceable unit, such as including a photoreceptor as well, that fits into a larger machine.

At some locations around the photoreceptor 102 it is desired to direct one or more electric fields toward the photoreceptor. Typically such stations are for initial charging or for transfer of marking material from the photoreceptor to a print sheet. In either case, a common device used for this purpose is called a "scorotron", an example of which is shown as 10. The scorotron 10 includes, in this embodiment, three "corona members" 20, 22, 24, each of which is a bare conductive member, such as a wire or a ribbon, which emits an electric field when it is electrically biased (by means not shown). Interposed between the corona members 20, 22, 24 and the adjacent surface of photoreceptor 102 is a screen 26, which may be externally biased as well to aid in directing electric fields from the corona members 20, 22, 24 to the photoreceptor 102.

Figure 2:
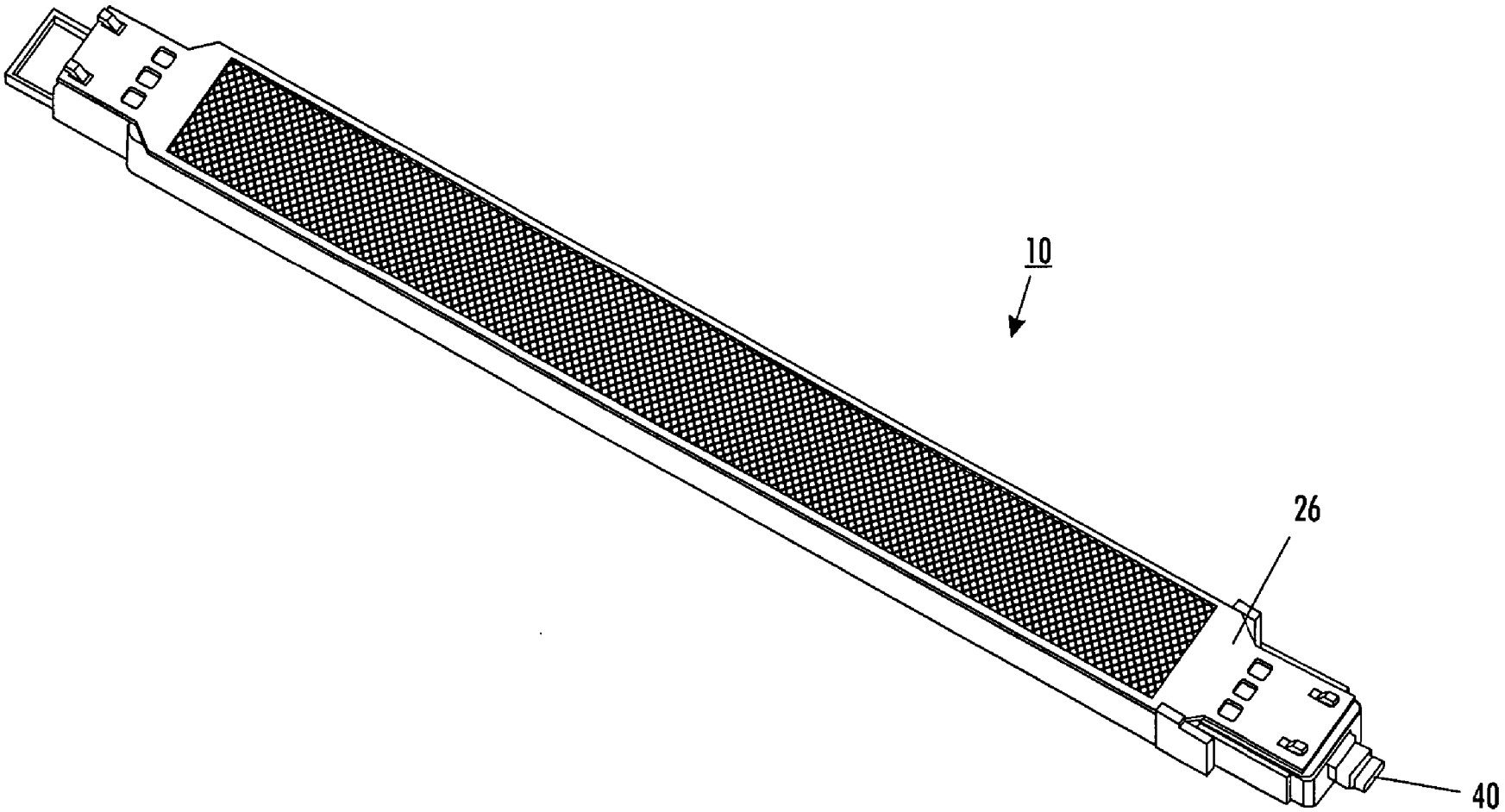
FIG. 2 shows a scorotron in isolation.

FIG. 2 shows a scorotron 10 in isolation. The corona members (not visible in this view) and the screen 26 (which can be considered part of the scorotron 10) extend the width of the photoreceptor 102 when the scorotron 10 is installed in printing apparatus 100. An electrical connection can be made from scorotron 10 to a voltage source within apparatus 100, such as through pin 40, which will be described in detail below.

FIGS. 3–4 and 7–8 are a series of perspective views showing one end of scorotron 10, in various stages of assembly. The end of the scorotron 10 shown in the Figures is the end at which the corona members 20, 22, 24 are electrically connected to a voltage source (not shown) inside printing apparatus 100.

The main piece at the end of scorotron 10 can be called an end block 28. The end block 28 is made largely of an insulative material, such as plastic. The end block 28 defines, in this embodiment, three distinct channels therein, indicated as 30, 32, and 34. Further in this embodiment, each of the corona members 20, 22, 24 is in the form of a conductive ribbon defining, along a main length thereof, a series of regularly-spaced sawtooth pins. The portion of each corona member 20, 22, 24 disposed within end block 28 does not define sawtooth pins, but extends through one of the respective channels 30, 32, 34. Each channel should substantially encase a portion of one corona member 20, 22, 24: the channel does not have to contact the corona member, but should be closely spaced therefrom.

Figure 3:
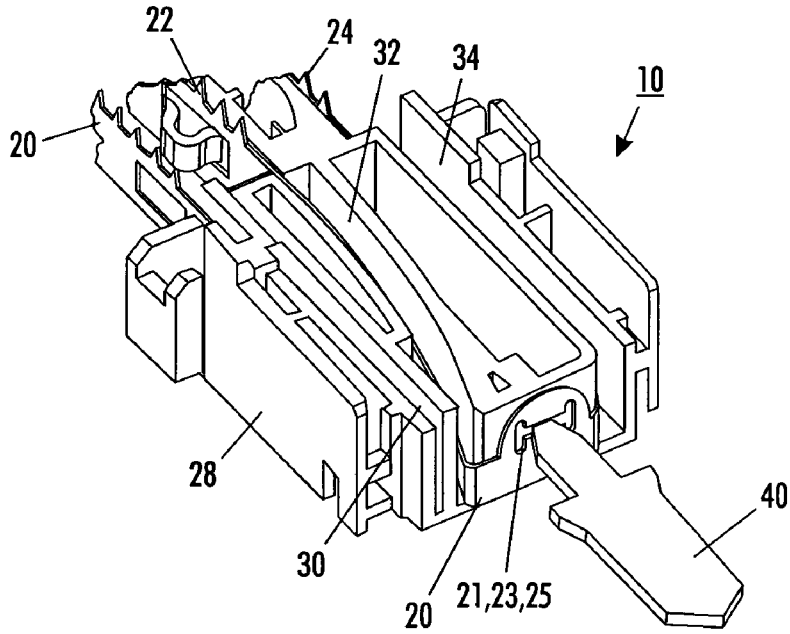
FIGS. 3–4 and 7–8 are a series of perspective views showing one end of a scorotron, in various stages of assembly.
Figure 4:
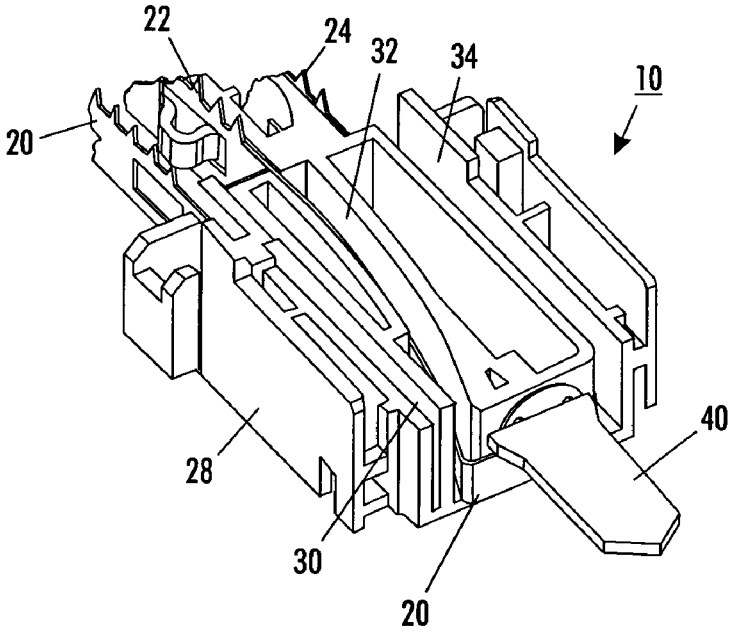

Anchored within end block 28 is a conductive pin 40, in the form of a flat spade, which is shown partially withdrawn from end block 28 in FIG. 3 and fully anchored in FIG. 4. The "profile" of the pin 40, meaning its shape along a section thereof, is not round; i.e., pin 40 in this embodiment is not a cylinder or screw. As can be seen in FIG. 3, a portion of pin 40 passes through an opening 21 defined at the end of corona member 20. Although it cannot be clearly shown, the opening 21 is aligned with a similar opening 23 at the end of corona member 22 and an opening 25 at the end of corona member 24. Pin 40 thus passes through all openings 21, 23, and 25.

Figure 5:
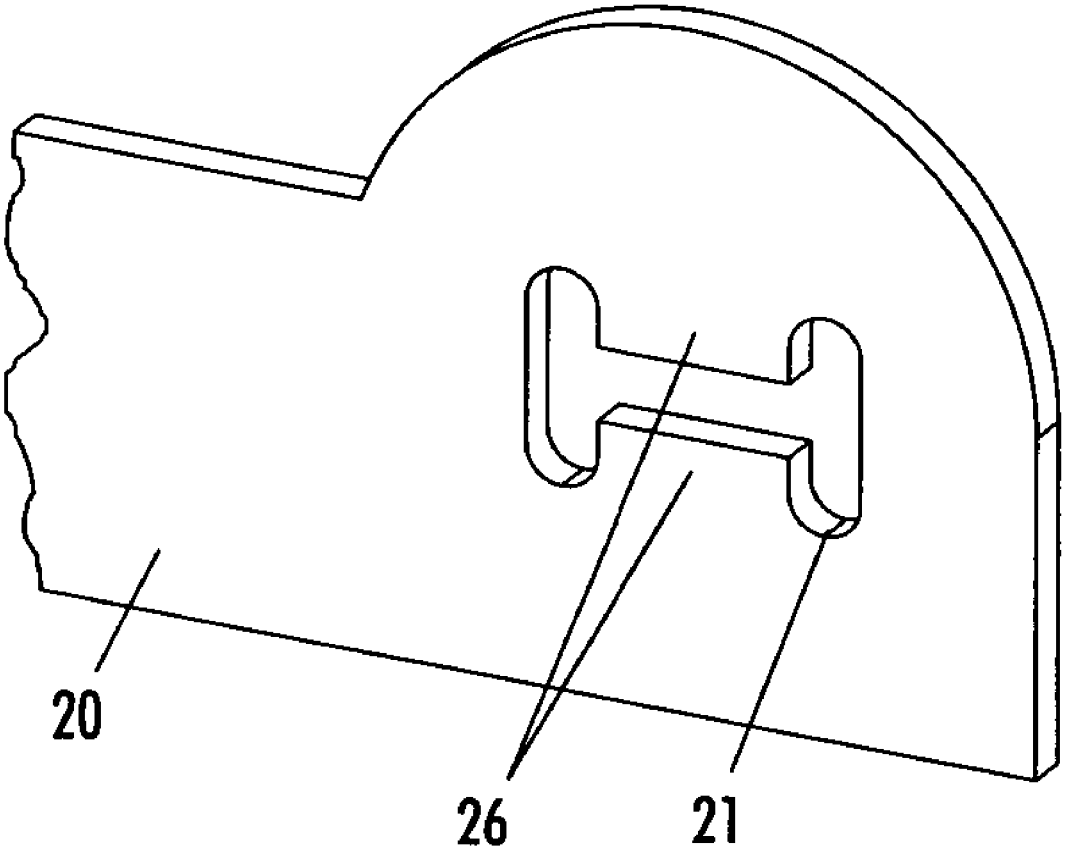
FIG. 5 shows an end of corona member in isolation.

FIG. 5 shows an end of corona member 20 in isolation, showing the shape of opening 21; similar openings are present in the other corona members. Opening 21 has a "dog-bone" shape, forming flaps 26. The flaps 26 are sized and shaped to bend when the pin 40 is inserted into opening 21, so that the flaps 26 are bent against the pin 40 when the assembly is complete; the resilience of the metal of the corona member such as 20 causes the bent flaps to urge against the pin 40. In the complete assembly, the openings 23, 25 in corona members 22 and 24 are also aligned to accept the pin 40 therethrough, and the equivalent flaps of each opening are thus urged against a portion of pin 40.

Figure 6:
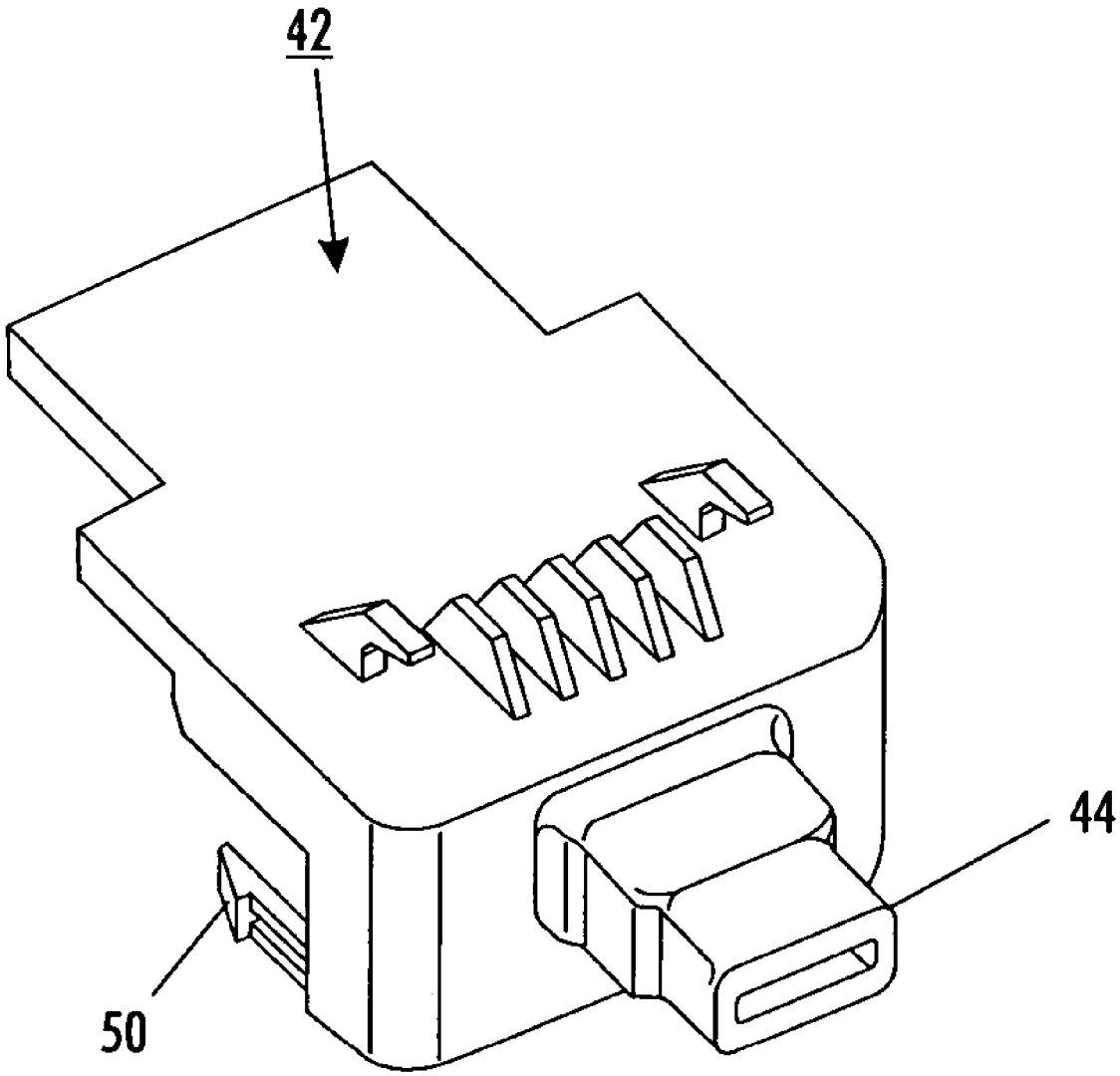
FIG. 6 shows an end block in isolation.
Figure 7:
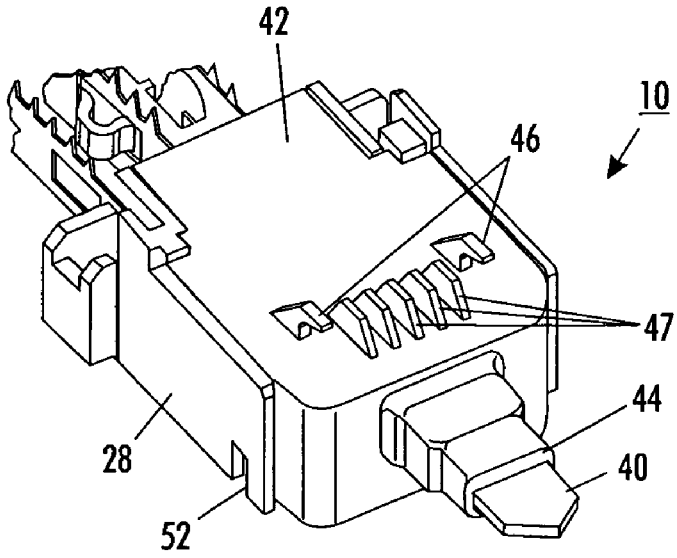

FIG. 6 shows a "cover block," generally indicated as 42, in isolation. Cover block 42, which can be made from a single piece of insulative material such as plastic, defines a collar 44 and a set of lugs 46. FIG. 7 shows a further step in the assembly process, following that shown in FIG. 4. In FIG. 7, cover block 42 is placed over the end block 28, in effect covering the channels 30, 32, 34, while collar 44 surrounds a portion of pin 40. As can be seen in FIGS. 6 and 7, cover block 42 further includes at least one flexible detent 50, which corresponds to a notch 52 in end block 28; the combination of the detent 50 and notch 52 enable the end block 28 and cover block 42 to snap together securely, typically without a need for tools.

Figure 8:
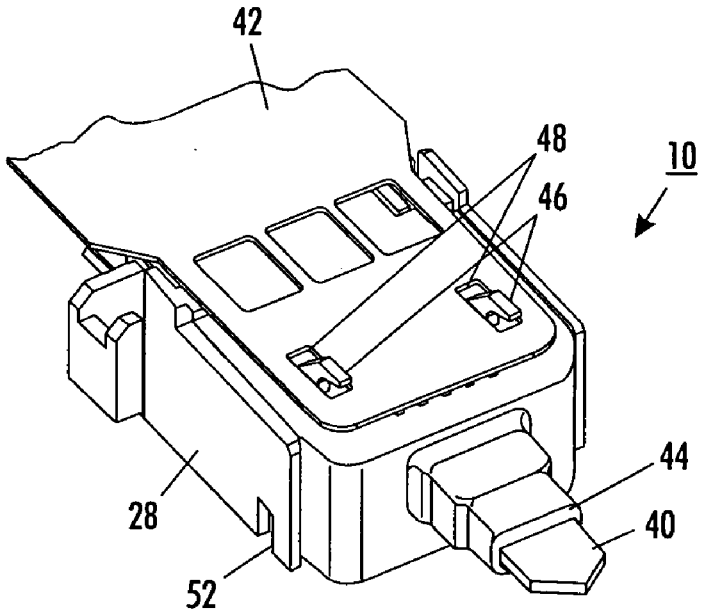

Turning to FIG. 8, which shows a further step in the assembly process, it can be seen that lugs 46 fit into openings 48 in the screen 26. The lugs 46 can be notched, as shown, so as to place a small tension on the screen 26 as it is mounted on the body of scorotron 10. Further structures, such as smaller lugs 47 between lugs 46 in FIG. 6, can be provided to maintain a desirable spacing between screen 26 and the rest of the scorotron 10.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A charging device useful in a printing apparatus, comprising:

a first corona member and a second corona member;

an end block defining at least two channels therein, each channel substantially encasing a portion of a corona member;

a conductive pin, a portion of the pin anchored in the end block, the pin having a non-round profile;

each of the first corona member and second corona member defining an opening engaging a portion of the conductive pin; and a cover block, substantially covering the channels in the end block.

2. The charging device of claim 1, the opening in the first corona member being aligned with the opening in the second corona member.

3. The charging device of claim 1, the opening in the first corona member defining at least one flap which is bent against the pin.

4. The charging device of claim 3, the opening in the second corona member defining at least one flap which is bent against the pin.

5. The charging device of claim 1, the first corona member including a substantially flat ribbon.

6. The charging device of claim 5, a pin array being defined in the ribbon.

7. The charging device of claim 1, at least one of the cover block and the end block defining at least one lug; and further comprising a screen, at least a portion of the screen being mounted on the lug.

8. The charging device of claim 7, the lug defining a notch, suitable for holding the screen at a predetermined tension.

9. The charging device of claim 1, at least one of the cover block and the end block including a detent for enabling the cover block and the end block to snap together.

10. A charging device useful in a printing appparatus, comprising;

a first corona member and a second corona member;

an end block defining at least two channels therein, each channel substantially encasing a portion of a corona member;

a conductive pin, a portion of the pin anchored in the end block;

each of the first corona member and second corona member defining an opening engaging a portion of the conductive pin; and cover block, substantially covering the channels in the end block, the cover block defining a collar substantially surrounding a portion of the pin.

11. A printing apparatus, comprising:

a charge receptor; and a charging device for directing charge to a portion of the charge receptor, the charging device including:

a first corona member and a second corona member, an end block defining at least two channels therein, each channel substantially encasing a portion of a corona member, a conductive pin, a portion of the pin anchored in the end block, each of the first corona member and second corona member defining an opening engaging a portion of the conductive pin, and a cover block, substantially covering the channels in the end block and defining a collar substantially surrounding a portion of the pin.

12. The apparatus of claim 11, the opening in the first corona member defining at least one flap which is bent against the pin.

13. The apparatus of claim 11, the first corona member including a substantially flat ribbon.

14. The apparatus of claim 13, a pin array being defined in the ribbon.

15. The apparatus of claim 11, at least one of the cover block and the end block defining at least one lug; and further comprising a screen, at least a portion of the screen being mounted on the lug.

16. The apparatus of claim 15, the lug defining a notch, suitable for holding the screen at a predetermined tension.

17. The apparatus of claim 11, at least one of the cover block and the end block including a detent for enabling the cover block and the end block to snap together.

18. The apparatus of claim 11, the printing apparatus being a replaceable unit which fits into a larger machine.

* * * * *